United States Patent [19]

Mattila

[11] 4,114,874

[45] Sep. 19, 1978

[54] APPLIANCE FOR SWIMMERS

[76] Inventor: Alvin J. Mattila, 2 Beaver St., San Francisco, Calif. 94114

[21] Appl. No.: 810,686

[22] Filed: Jun. 27, 1977

[51] Int. Cl.[2] ..... A63B 69/12

[52] U.S. Cl. ..... 272/71; 188/82.77; 242/107.4 R; 254/152; 254/DIG. 12; 272/132; 272/DIG. 3; 272/DIG. 4

[58] Field of Search ..... 272/71, 72, 128, 131, 272/132, 133, 143, 26, 116, 125, 1 B, DIG. 3, DIG. 4; 73/141 R, 141 A, 141 AB, 379, 380, 381; 9/301, 310 J, 313; 242/107.4 R, 107.4 A, 107.4 B, 107.4 C, 107.4 D, 107.4 E; 188/82.7, 82.74, 82.77, 71.2; 254/152, 186 R, 142, DIG. 12; 192/46; 74/577 S, 577 SF

[56] References Cited

U.S. PATENT DOCUMENTS

| | | | |
|---|---|---|---|
| 518,967 | 5/1894 | Poole | 272/132 |
| 835,985 | 11/1906 | Sharp | 254/152 |
| 2,394,523 | 2/1946 | Pancoe | 242/107.4 R |
| 3,929,331 | 12/1975 | Beeding | 272/132 |
| 4,007,927 | 2/1977 | Proctor | 272/132 X |

FOREIGN PATENT DOCUMENTS

| | | | |
|---|---|---|---|
| 2,274,322 | 1/1976 | France | 272/133 |
| 1,078,777 | 8/1967 | United Kingdom | 272/131 |

*Primary Examiner*—Richard J. Johnson
*Assistant Examiner*—Arnold W. Kramer
*Attorney, Agent, or Firm*—Thomas H. Olson

[57] ABSTRACT

A housing and a spool supported within the housing for rotation therein. A rope or like tension member wound on the spool and having at its free end a harness for engaging a swimmer's waist. A brake disc within the housing and a ratchet and pawl mechanism for coupling the spool and the disc only in the direction of rotation corresponding to unwinding the rope from the spool. A brake mechanism cooperable with the disc and being adjustable to apply a desired frictional force on the disc to retard the swimmer's movement through the water. A spring for retracting the rope onto the spool.

1 Claim, 8 Drawing Figures

Fig-1
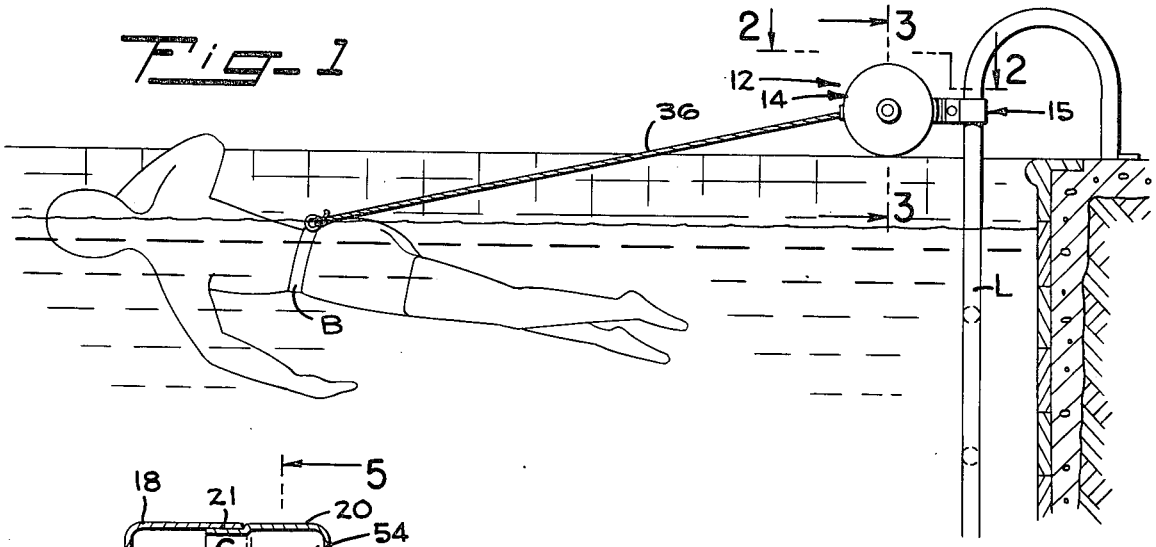
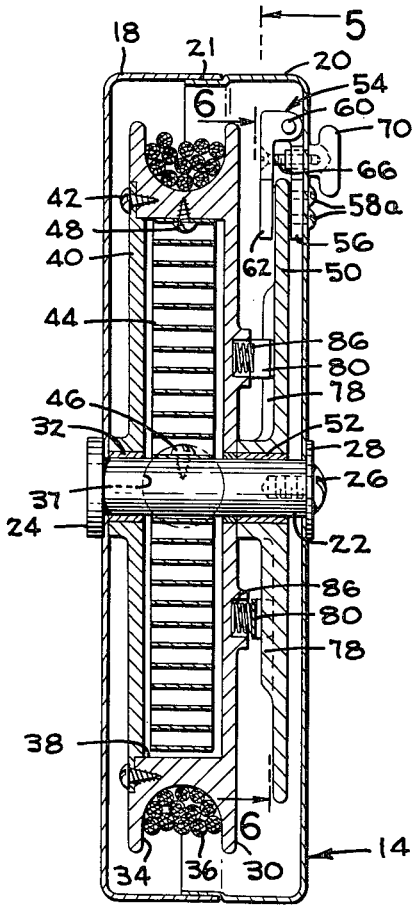
Fig-3
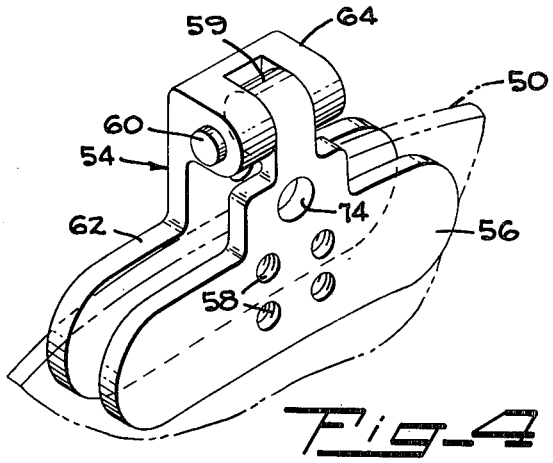
Fig-4
Fig-2
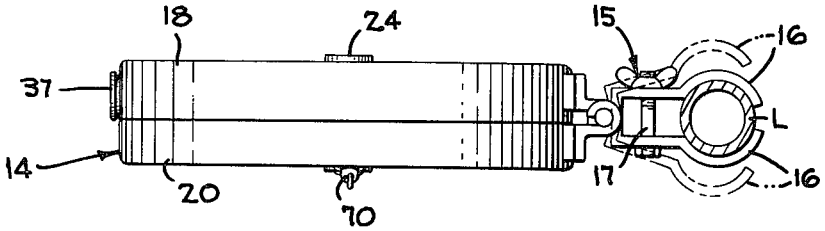

Fig-5
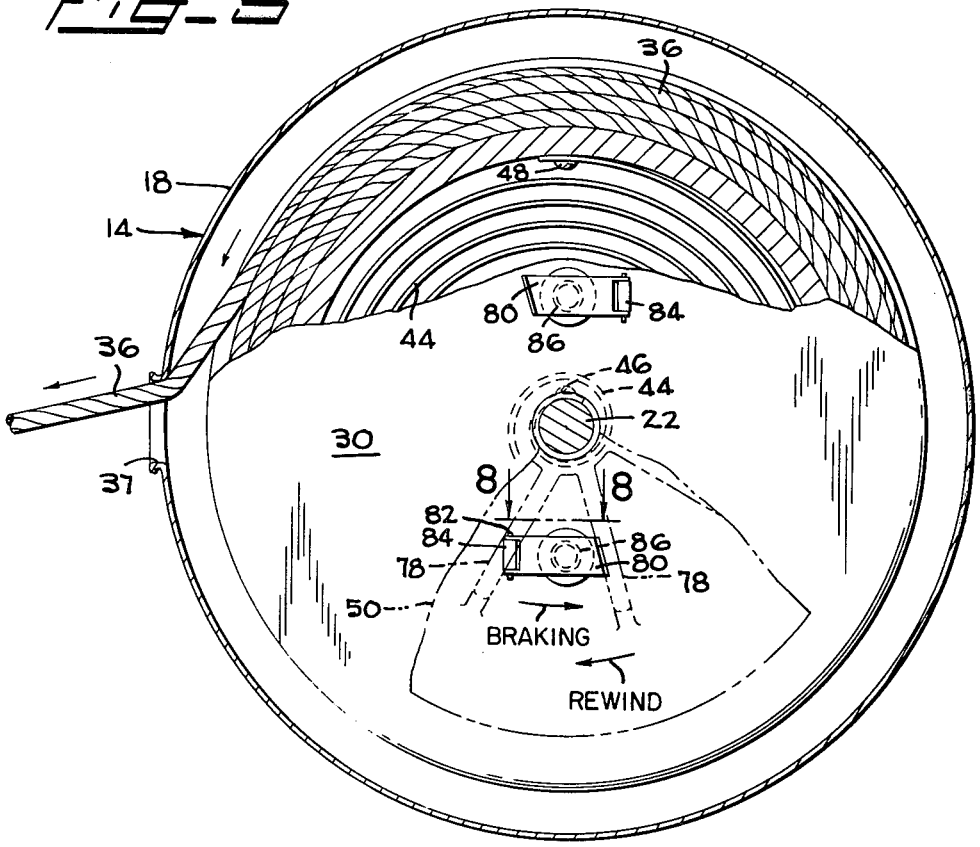
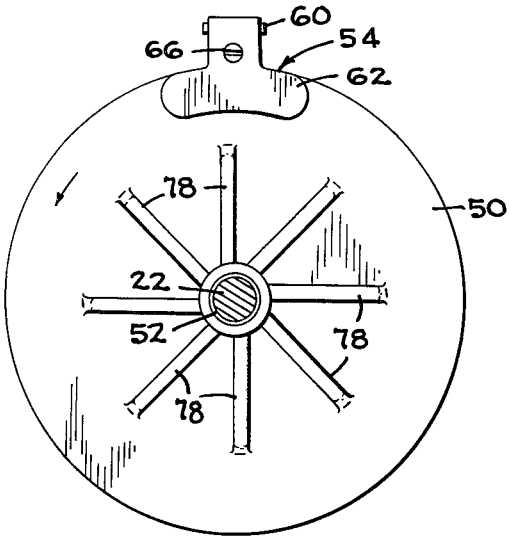
Fig-6
Fig-7
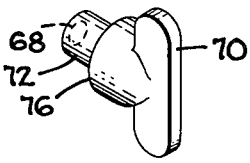
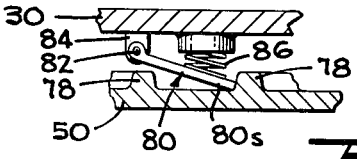
Fig-8

APPLIANCE FOR SWIMMERS

1

BACKGROUND OF THE INVENTION

1. Field of the Invention

This invention relates to an appliance for swimmers and more particularly to an appliance that can be attached to the swimmer and can be adjusted to impose a desired resistive force on the swimmer to enhance the benefits of exercise obtained in swimming.

2. Description of the Prior Art

U.S. Pat. No. 3,861,675 and French Pat. No. 1,385,295 disclose swimmers' appliances which employ a pulley and rope system and a series of weights associated with such system. These devices require permanent installation adjacent a swimming pool.

U.S. Pat. No. 2,825,224 discloses a swimmer's appliance employing a spring balance scale mounted on the side of the pool and a cable connected to the balance scale at one end and having at the other end a belt for connection with the swimmer. The device affords no adjustability but merely indicates on the spring balance scale the amount of force applied thereto by the swimmer. Moreover, full utilization of the patented device requires an assistant to observe the scale.

U.S. Pat. No. 3,512,416 discloses a swimming apparatus which affords resistance to a swimmer's stroke by means of a large and cumbersome dash pot or hydraulic structure.

U.S. Pat. No. 3,929,331 discloses an exercise device employing a spool and a compression spring together with mechanism for linking the spool and the compression spring to retard rotation of the spool.

SUMMARY OF THE INVENTION

According to the present invention there is a relatively small housing having on the exterior thereof a clamp to enable the user to clamp the housing adjacent the edge of a swimming pool or like body of water. Supported for rotation within the housing is a spool on which a rope or cable is wound. The free end of the rope, which extends exterior of the housing, is provided with a belt for attachment to a swimmer's waist. Within the housing is provided an adjustable variable resistance brake mechanism which is arranged to retard rotation of the spool when the rope is withdrawn therefrom but which is free running with respect to spool rotation in the opposite direction. A spring is provided for rewinding the rope into the housing when use of the device has terminated, such rewinding being totally unimpaired by the variable force brake mechanism.

An object of the invention is to provide a swimmer's appliance that is of extremely small size so that it can be carried by travelers in their luggage. Achievement of this object enables those desiring daily exercise to obtain it in any facility where there is a swimming pool, and is possible because the brake mechanism which affords resistance to unwinding movement of the spool is extremely compact.

Another object is to provide a swimmer's appliance which can be adjusted to increase the drag as the swimmer's stroke technique and strength improve. This object is achieved because the brake mechanism included as an element in the present invention is adjustable to alter the degree of resistance and friction afforded thereby.

A further object of the invention is to provide an appliance that can be quickly stored after use. This object is achieved by providing a coupling mechanism between the brake and the spool which permit free rotation of the spool in a direction to retract the rope wound upon the spool. A spring is incorporated in the device which provides the force for so rewinding the rope.

A still further object is to provide a swimmer's appliance that avoids pulling the swimmer backward through the water should he pause for rest. This object is accomplished because the above mentioned spring produces a force having a magnitude only sufficient to retract the rope and because the brake affords a resistive force on the spool.

Yet another object is to provide a device which can be quickly clamped on to and removed from a ladder, bar, or like structure mounted adjacent a pool edge. Accomplishment of this object is important in providing a lightweight portable device.

The foregoing together with other objects, features and advantages will be more apparent after referring to the following specification and the accompanying drawings.

BRIEF DESCRIPTION OF THE DRAWINGS

FIG. 1 is an elevation view showing a swimmer utilizing the appliance of the present invention.

FIG. 2 is a top view of an exemplary appliance embodying the invention.

FIG. 3 is a cross-sectional view at enlarged scale and taken along line 3—3 of FIG. 1.

FIG. 4 is a fragmentary perspective view of the friction brake shoe constituting an element of the present invention.

FIG. 5 is an elevation view of the appliance taken along line 5—5 of FIG. 3.

FIG. 6 is a view of a portion of the one-way clutch of the invention taken along line 6—6 of FIG. 3.

FIG. 7 is a perspective view at enlarged scale of a portion of the brake shoe adjusting mechanism employed in the invention.

FIG. 8 is a fragmentary cross-sectional view taken along line 8—8 of FIG. 5 and showing the one-way clutch of the invention.

DESCRIPTION OF THE PREFERRED EMBODIMENT

Referring more particularly to the drawings, reference numeral 12 indicates generally a swimmer's appliance according to the present invention. The appliance includes a housing 14 having an external clamp structure 15 which, in FIG. 1, is shown fastened to a swimming pool ladder L, typically constructed of tubing having an outer diameter of approximately 2 inches. Clamp structure 15 includes a pair of identical clamp members 16 that are mounted to housing 14 for relative pivotal movement. The free ends of clamp members 16 have semi-cylindric portions, radiused to embrace ladder L, a screw wing nut combination 17 being provided to draw the clamp members together for embracing the ladder and securing housing 14 adjacent the pool edge. Housing 14 is constructed of two interlocking housing portions 18 and 30 which telescope together at a center seam 21 as shown in FIG. 3 to form a hollow enclosure. The housing portions are retained in assembled condition by a central shaft 22 which has an integral enlarged head 24 at one end thereof which bears upon the exterior surface of housing portion 18. At the opposite end the shaft is tapped to receive a screw 26 which retains a flat washer 28 against the surface of housing portion 20 thus to fix the two housing portions together.

Shaft 22 also functions to support for rotation within housing 14 a spool 30, there being an anti-friction bushing 32 to afford rotation of the spool on the shaft. The outer periphery of spool 30 defines a generally U-shaped slot 34 in which a rope or cable 36 is wound. The inner or proximal end of rope 36 is fixed to spool 30 within U-shaped groove 34 and the outer or distal end of the rope is fixed to a belt B which circumscribes the swimmer's waist. Housing portion 18 is provided with a smooth edged opening 37 through which rope 36 extends and is guided by the smooth edge.

Spool 30, as seen most clearly in FIG. 3, is of composite structure so as to define a cylindrical cavity 38 which is concentric with shaft 22 and is enclosed by a circular cover plate 40. Screws 42 are provided for securing the cover plate onto the body. Within the cylindrical cavity there is a flat spiral spring 44, the inner end of which is secured to shaft 22 by means of a screw 46 and the outer end of which is secured to spool 30 by means of a screw 48. Spring 44 is oriented so as to store energy when rope 36 is withdrawn from spool 30, the stored energy serving to rewind the rope onto the spool when force is removed from the distal end of the rope. The spring is constructed of material having properties and dimension such that the force produced thereby is sufficient to rewind rope 36 onto spool 30 but insufficient to avoid pulling a swimmer wearing belt B backward through the water.

Also supported for rotation on shaft 22, independently of spool 30, is a brake disc 50. The brake disc is formed of any suitable material having appropriate strength and wear characteristics such as steel, plastic, or the like. An anti-friction bushing 52 supports the brake disc for free rotation on shaft 22. As can be seen most clearly in FIG. 3, brake disc 50 has two parallelly spaced apart surfaces and as seen in FIG. 6, has a circular shape concentric with shaft 22. A brake shoe assembly 54 is provided for applying an adjustable frictional force to brake disc 50 to resist rotation thereof. Brake shoe assembly 54 has a fixed pad 56 which is secured to housing portion 20, the fixed pad being provided with tapped holes 58 which receive screws **58*a* therein that pass through the side wall of housing portion 20. At the outward radial extremity of fixed pad 56 is an extension 59 which defines a bore for receiving a pivot pin 60. As shown in FIGS. 3 and 4, pin 60 is oriented parallel to a tangent of the periphery of brake disc 50. There is a movable pad 62 which includes an extension 64 having a bifurcated portion adapted to embrace extension 59; the furcations of extension 64 are bored to receive pivot pin 60 so that pad 62 pivots with respect to pad 56. Pads 56 and 62 are elongated circumferentially so as to afford an adequate frictional contact area with the respective surfaces of disc 50**.

Between the outer periphery of brake disc 50 and pivot pin 60 there is a brake pressure adjusting mechanism that includes a screw 66 which extends through aligned holes in the respective extensions 64 and 59 so that the outer end of the screw engages the threads in an internally threaded opening 68 in a brake pressure adjusting knob 70. As seen in FIG. 3, knob 70 is accessible from the exterior of housing 14.

Knob 70 includes a cylindric portion 72 which is received in a correspondingly sized hole 74 formed in a portion of fixed pad 56 in alignment with screw 66. Surrounding cylindric portion 72 is a shoulder 76 which bears on the outer surface of fixed brake pad 56. Thus, rotation of handle 70 in a clockwise direction draws movable brake pad 62 toward fixed pad 56 in consequence of which frictional force is applied to the opposite surfaces of brake disc 50.

The resistive force provided by cooperation between brake disc 50 and brake shoe assembly 54 is coupled to spool 30 in the direction of rotation thereof corresponding to unwinding movement of rope 36 but is decoupled from the spool during rotation in the opposite direction. To achieve this mode of operation, disc 50 is provided with a plurality of generally radially extending teeth or ribs 78 on the surface thereof that confronts spool 30. The side surface of the spool is provided with one or more spring loaded pawls 80 which engage the teeth in one direction of rotation but not in the other. An can be seen in FIGS. 3, 5 and 8, pawl 80 has an inner end which is fixed to spool 30 for relative pivotal movement by means of a pin 82 which extends through the inner end of the pawl and a boss 84 formed on the surface of the spool. Between the inner and outer ends of pawl 80 is a compression spring 86 which biases the outer or free end of the pawl into engagement with the surface of brake disc 50 and teeth 78. Referring to FIG. 8, when rope 36 is being withdrawn from the spool, the portion of the spool shown in the figure moves upward as seen in the figure. Consequently, the free end of pawl 80 abuts the side surface of tooth 78 on the brake disc, in consequence of which spool rotation is retarded to a degree corresponding to the pressure applied by brake shoe assembly 54 on disc 50. Contrariwise, when spool 30 rotates in the opposite direction, in response to the force stored in spring 44, the portion of the spool depicted in FIG. 8 moves downward, in which direction the outer surface **80*s* of pawl 80 slides over tooth 78 because spring 86 yields to permit pawl 80 to ride over the tooth without significant resistance. Thus pawl 80, spring 86 and teeth 78 coact in the manner of a one-way or overrunning clutch. Disclosure of two pawls 80 and eight teeth 78** is only exemplary and is not intended to be limiting.

In operation housing 12 is first attached to ladder L by loosening screw-wing nut combination 17 in order that clamp members 16 can be spread to receive ladder L therebetween. Then the wing nut is tightened to solid line position seen in FIG. 2 thereby securely fixing the housing to the ladder. Next, the swimmer withdraws a length of rope 36 by pulling it out of the housing in response to which spool 30 rotates within the housing. During this action force is stored in spring 44. Next, the swimmer adjusts brake mechanism 54 by rotating knob 70 to achieve the desired amount of frictional force on the side surfaces of disc 50 by pads 56 and 62. Finally, the swimmer installs belt B around his waist, enters the water and proceeds to swim. If he progresses through the water too rapidly, he need only tighten knob 70 somewhat to increase the resistive force. Because the housing can be installed immediately adjacent the edge of the pool, such adjustment can be made without the swimmer leaving the water. The optimum adjustment for the brake assembly with respect to disc 50 is such that the swimmer can stroke vigorously and make little or no progress across the pool. Thus, even in extremely small pools, as one might encounter in certain small motels, substantial and continuous exercise can be obtained even though the pool is extremely short. Should the swimmer desire to rest momentarily, he can do so conveniently because the force stored in spring 44 is a relatively small force and is insufficient to pull him back toward housing 14. When the swimmer has completed his workout, he need only remove belt B from his waist and release it so as to enable spring 44 to wind rope 36 onto spool 30. Such action is not retarded by co-action between brake assembly 54 and disc 50 because surfaces 80*s* of pawls 80 ride over teeth 78 rather than engaging them. Finally, the user can remove the housing from the ladder by loosening the wing nut whereupon he can store the device for subsequent use or transport.

Thus, it will be seen that the present invention provides a compact portable device that enhances the value of swimming as an exercise. The device permits vigorous exercise even in extremely small pools. Because of the adjustability of the force applied by brake assembly 54, the device can be used by swimmers of all proficiency levels. Although one embodiment of the invention has been shown and described, it will be obvious that other adaptations and modifications can be made without departing from the true spirit and scope of the invention.

What is claimed is:

1. An appliance for swimmers comprising a housing, means for fixing said housing adjacent a body of water, a shaft mounted in said housing, a spool disposed in said housing and supported for rotation on said shaft, said spool having a side surface substantially normal to said shaft, a flexible tension member wound on said spool and having a proximal end fixed to said spool and a distal end exterior of said housing, means for securing said distal end to the body of a swimmer in a body of water, means in said housing for rotatively biasing said spool in a first direction for winding said tension member thereon, a friction disc supported within said housing for rotation on said shaft, said disc having a first surface parallelly confronting said side surface and a second surface parallelly spaced from said first surface, decoupling means operatively connecting said spool side surface to said first disc surface so that said spool rotates independently of said disc in said first direction of rotation and engages said disc for rotation therewith in the opposite rotative direction, a brake assembly secured to said housing in flanking relation to the outer peripheral margin of said disc, said brake having first and second relatively movable surface defining portions for frictionally engaging respective said disc surfaces, said second surface defining portion of said brake being rigid with said housing, and means for adjustably compressing said surface portions toward one another and into frictional engagement with said disc surfaces so as to afford an adjustable force of friction between said brake assembly and said disc for retarding spool rotation in a direction opposite said first direction, said decoupling means including at least one pawl pivotally mounted to said side surface of said spool radially inward of said peripheral margin and disposed at an acute angle to said surface, means for biasing said pawl toward said first disc surface, said first disc surface defining a plurality of radially extending teeth projecting therefrom toward said side surface for cooperation with said pawl to engage said pawl in a direction opposite said first direction and rotate independently of said pawl in said first direction, said teeth being uniformly spaced around said friction disc and terminating radially inward of said peripheral margin.

* * * * *